US011078046B2

(12) United States Patent
Schmidt et al.

(10) Patent No.: US 11,078,046 B2
(45) Date of Patent: Aug. 3, 2021

(54) ELEVATOR SYSTEM SUSPENSION MEMBER TERMINATION WITH CONTAINMENT

(71) Applicant: Otis Elevator Company, Farmington, CT (US)

(72) Inventors: Walter Thomas Schmidt, Marlborough, CT (US); Daniel A. Mosher, Glastonbury, CT (US); Joseph C. Rampone, Colchester, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 714 days.

(21) Appl. No.: 15/842,192

(22) Filed: Dec. 14, 2017

(65) Prior Publication Data

US 2018/0162697 A1 Jun. 14, 2018

Related U.S. Application Data

(60) Provisional application No. 62/434,057, filed on Dec. 14, 2016.

(51) Int. Cl.
*B66B 7/08* (2006.01)
*B66B 7/06* (2006.01)

(52) U.S. Cl.
CPC ..... *B66B 7/085* (2013.01); *B66B 7/062* (2013.01)

(58) Field of Classification Search
CPC ..... B66B 7/085; B66B 7/08; B66B 7/062
See application file for complete search history.

(56) References Cited

U.S. PATENT DOCUMENTS

| | | | | |
|---|---|---|---|---|
| 4,561,154 | A * | 12/1985 | Briscoe | F16G 11/046 24/115 M |
| 4,845,814 | A | 7/1989 | Crook | |
| 6,256,841 | B1 | 7/2001 | Ericson et al. | |
| 6,662,408 | B2 | 12/2003 | Perez et al. | |
| 7,886,878 | B2 | 2/2011 | Ericson et al. | |
| 8,181,312 | B2 | 5/2012 | Attinger et al. | |
| 8,505,173 | B2 | 8/2013 | Pitts et al. | |
| 9,004,232 | B2 | 4/2015 | Attinger | |

(Continued)

FOREIGN PATENT DOCUMENTS

| | | |
|---|---|---|
| CN | 1234362 A | 11/1999 |
| CN | 101687611 A | 3/2010 |

(Continued)

OTHER PUBLICATIONS

Chinese Office Action for Chinese Application No. 201711334418.6, dated Mar. 5, 2020.

(Continued)

*Primary Examiner* — Diem M Tran
(74) *Attorney, Agent, or Firm* — Cantor Colburn LLP

(57) ABSTRACT

A termination device for a suspension member of an elevator system includes a housing and a wedge located in the housing. The wedge extends across a width of the suspension member and at least partially across a thickness of the suspension member. The wedge is interactive with the suspension member to apply a clamping force to the suspension member in response to an axial load acting on the suspension member. The wedge includes a wedge lip configured to contain the suspension member within a lateral extent of the wedge.

10 Claims, 7 Drawing Sheets

(56) References Cited

U.S. PATENT DOCUMENTS

| | | | |
|---|---|---|---|
| 9,347,520 | B2 | 5/2016 | Wolf |
| 9,422,134 | B2 | 8/2016 | Ikonen et al. |
| 2015/0059132 | A1 | 3/2015 | Seitz |
| 2015/0151948 | A1 | 6/2015 | Pelto-Huikko |
| 2016/0185572 | A1 | 6/2016 | Lehtinen et al. |
| 2016/0207739 | A1 | 7/2016 | Pelto-Huikko |
| 2016/0355378 | A1 | 12/2016 | Lehtinen et al. |

FOREIGN PATENT DOCUMENTS

| | | | | |
|---|---|---|---|---|
| CN | 102358550 | A | 2/2012 | |
| CN | 203212163 | U | 9/2013 | |
| DE | 102008018191 | A1 | 10/2009 | |
| EP | 1028911 | B1 | 9/2006 | |
| EP | 3103754 | A1 * | 12/2016 | ..... B66B 7/062 |
| JP | 2005047673 | | 2/2005 | |
| JP | 2006306556 | A | 11/2006 | |
| JP | 5625763 | B2 | 11/2014 | |
| WO | 0040497 | A1 | 7/2000 | |
| WO | 2010000330 | A1 | 1/2010 | |
| WO | 2013110850 | A1 | 8/2013 | |
| WO | WO-2018108689 | A1 * | 6/2018 | ..... B66B 9/00 |

OTHER PUBLICATIONS

European Search Report Issued in EP Application No. 17207518.6, dated May 4, 2018, 10 Pages.

* cited by examiner

ELEVATOR SYSTEM SUSPENSION MEMBER TERMINATION WITH CONTAINMENT

CROSS-REFERENCE TO RELATED APPLICATIONS

This application claims the benefit of 62/434,057, filed Dec. 14, 2016, which is incorporated herein by reference in its entirety.

BACKGROUND

The subject matter disclosed herein relates to elevator systems. More particularly, the present disclosure relates to termination of suspension members of elevator systems.

A typical elevator system includes an elevator car, suspended by one or more suspension members, typically a rope or belt, that moves along a hoistway. The suspension member includes one or more tension members and is routed over one or more sheaves, with one sheave, also known as a drive sheave, operably connected to a machine. The machine drives movement of the elevator car via interaction of the drive sheave with the suspension member. The elevator system further typically includes a counterweight interactive with the suspension member. One or more of the ends of the suspension member are terminated to provide reliable connection to the elevator car and/or counterweight.

Elevator belts typically include tension members at least partially enclosed in a jacket material. Terminations for such elevator belts often utilize wedge-based terminations to capture a substantially straight portion of the elevator belt. In a wedge-based termination, when a tensile load is applied to the belt, a wedge interactive with a housing applies a clamping force to the belt to retain the belt at the termination. With an increase in tensile load per unit width of the belt, the clamping force applied to the belt by the wedge increases. In some belt configurations, the high clamping force can result in creep or flow of the jacket material of the belt between wedge elements and/or between wedge and housing elements of the termination. The flow or creep of the jacket material causes damage to the jacket and the belt and increases difficulty of maintaining a desired clamping force to retain the belt at the termination.

BRIEF DESCRIPTION

In one embodiment, a termination device for a suspension member of an elevator system includes a housing and a wedge located in the housing. The wedge extends across a width of the suspension member and at least partially across a thickness of the suspension member. The wedge is interactive with the suspension member to apply a clamping force to the suspension member in response to an axial load acting on the suspension member. The wedge includes a wedge lip configured to contain the suspension member within a lateral extent of the wedge.

Additionally or alternatively, in this or other embodiments the termination includes two opposing wedges, each wedge of the two opposing wedges having a wedge lip.

Additionally or alternatively, in this or other embodiments a first wedge lip of a first wedge of the two opposing wedges is configured to approach a second wedge lip of a second wedge of the two opposing wedges.

Additionally or alternatively, in this or other embodiments a first wedge lip of a first wedge of the two opposing wedges is configured to overlap a second wedge lip of a second wedge of the two opposing wedges.

Additionally or alternatively, in this or other embodiments the wedge is formed from a first material and the wedge lip is formed from a second material softer than the first material.

Additionally or alternatively, in this or other embodiments the wedge lip is compressible.

In another embodiment, a termination assembly of a belt for an elevator system includes a belt having a plurality of tension members extending along a length of the belt and a jacket at least partially enclosing the plurality of tension members and a termination device. The termination device includes a housing and a wedge located in the housing. The wedge extends across a lateral width of the belt and at least partially across a thickness of the belt. The wedge is interactive with the belt to apply a clamping force to the belt in response to an axial load acting on the belt. The wedge includes a wedge lip configured to contain the belt within a lateral extent of the wedge.

Additionally or alternatively, in this or other embodiments the termination device includes two opposing wedges, at least one wedge of the two opposing wedges having a wedge lip.

Additionally or alternatively, in this or other embodiments a first wedge lip of a first wedge of the two opposing wedges is configured to approach a second wedge lip of a second wedge of the two opposing wedges.

Additionally or alternatively, in this or other embodiments a first wedge lip of a first wedge of the two opposing wedges is configured to overlap a second wedge lip of a second wedge of the two opposing wedges.

Additionally or alternatively, in this or other embodiments the wedge lip is compressible.

Additionally or alternatively, in this or other embodiments the plurality of tension members are formed from a plurality of fibers bonded to a polymer matrix.

Additionally or alternatively, in this or other embodiments the jacket is formed from an elastomeric material.

In yet another embodiment, an elevator system includes a hoistway, an elevator car positioned in the hoistway, a belt operably connected to the elevator car to suspend and/or drive the elevator car along the hoistway, and a termination device located in the hoistway and operably connected to a belt end of the belt. The termination device includes a housing and a wedge located in the housing. The wedge extends across a lateral width of the belt and at least partially across a thickness of the belt. The wedge is interactive with the belt to apply a clamping force to the belt in response to an axial load acting on the belt. The wedge includes a wedge lip configured to contain the belt within a lateral extent of the wedge.

Additionally or alternatively, in this or other embodiments the termination device is located at the elevator car or a counterweight of the elevator system.

Additionally or alternatively, in this or other embodiments the termination device includes two opposing wedges, at least one wedge of the two opposing wedges having a wedge lip.

Additionally or alternatively, in this or other embodiments a first wedge lip of a first wedge of the two opposing wedges is configured to approach a second wedge lip of a second wedge of the two opposing wedges.

Additionally or alternatively, in this or other embodiments a first wedge lip of a first wedge of the two opposing wedges is configured to overlap a second wedge lip of a second wedge of the two opposing wedges.

Additionally or alternatively, in this or other embodiments the wedge lip is compressible.

Additionally or alternatively, in this or other embodiments the plurality of tension members are formed from a plurality of fibers bonded to a polymer matrix.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
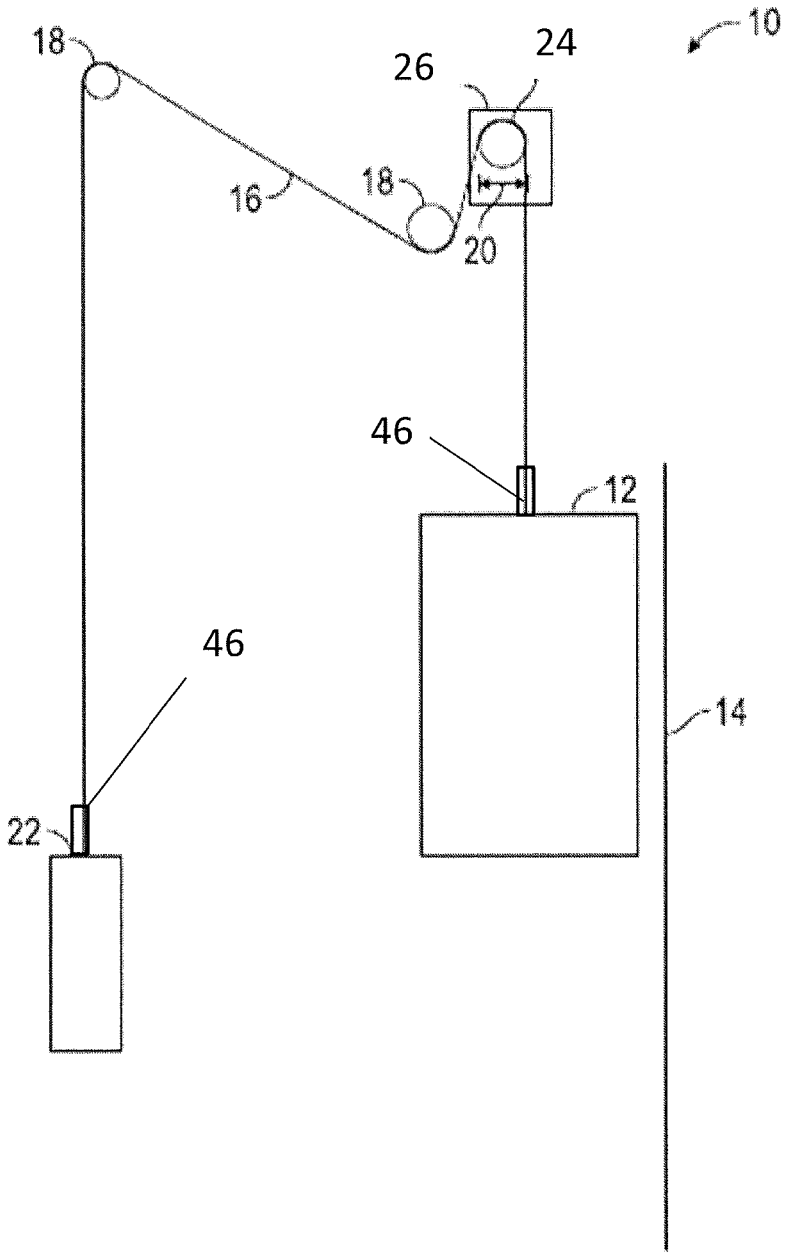
FIG. 1 is a schematic view of an exemplary elevator system.

Shown in FIG. 1, is a schematic view of an exemplary traction elevator system 10. Features of the elevator system 10 that are not required for an understanding of the present invention (such as the guide rails, safeties, etc.) are not discussed herein. The elevator system 10 includes an elevator car 12 operatively suspended or supported in a hoistway 14 with one or more belts 16. The one or more belts 16 may be connected to the elevator car 12 via a termination 46. The one or more belts 16 interact with one or more sheaves 18 to be routed around various components of the elevator system 10. The one or more belts 16 could also be connected to a counterweight 22 via a termination 46. The counterweight 22 is used to help balance the elevator system 10 and reduce the difference in belt tension on both sides of the traction sheave during operation.

The sheaves 18 each have a diameter 20, which may be the same or different than the diameters of the other sheaves 18 in the elevator system 10. At least one of the sheaves could be a traction sheave 24. The traction sheave 24 is driven by a machine 26. Movement of drive sheave by the machine 26 drives, moves and/or propels (through traction) the one or more belts 16 that are routed around the traction sheave 24. At least one of the sheaves 18 could be a diverter, deflector or idler sheave. Diverter, deflector or idler sheaves are not driven by a machine 26, but help guide the one or more belts 16 around the various components of the elevator system 10.

In some embodiments, the elevator system 10 could use two or more belts 16 for suspending and/or driving the elevator car 12. In addition, the elevator system 10 could have various configurations such that either both sides of the one or more belts 16 engage the one or more sheaves 18 or only one side of the one or more belts 16 engages the one or more sheaves 18. The embodiment of FIG. 1 shows a 1:1 roping arrangement in which the one or more belts 16 terminate at the car 12 and counterweight 22 via the termination 46, while other embodiments may utilize other roping arrangements.

The belts 16 are constructed to have sufficient flexibility when passing over the one or more sheaves 18 to provide sufficiently low bending stresses, meet belt life requirements and have smooth operation, while being sufficiently strong to be capable of meeting strength requirements for suspending and/or driving the elevator car 12.

Figure 2:
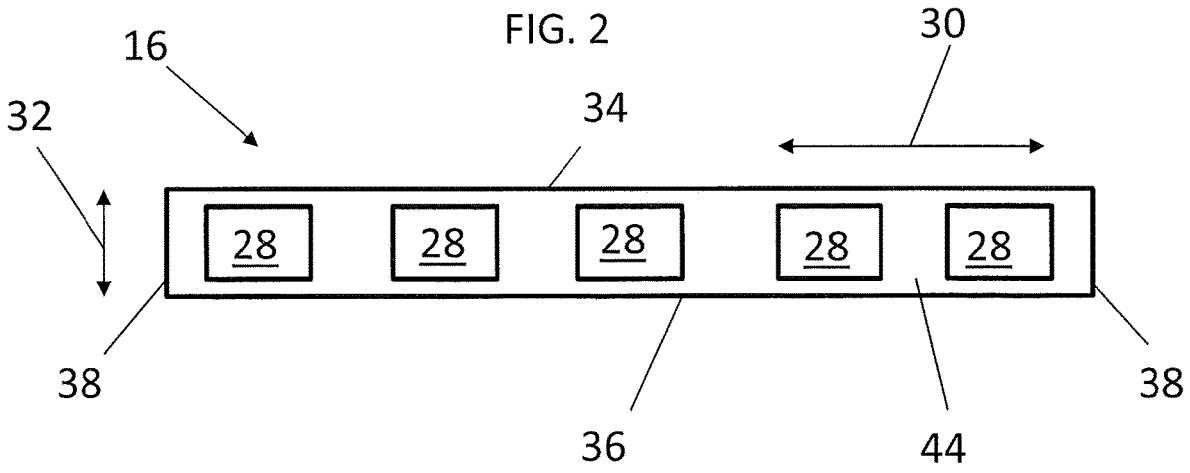
FIG. 2 is a cross-sectional view of an embodiment of a belt for an elevator system.

FIG. 2 provides a cross-sectional schematic of an exemplary belt 16 construction or design. The belt 16 includes a plurality of tension elements 28 extending longitudinally along the belt 16. While the tension elements 28 in the embodiment of FIG. 2 are rectangular in cross-section, it is to be appreciated that other cross-sectional shapes, such as circular, may be utilized in other embodiments. The tension elements 28 may be at least partially encased in a jacket 44, in some embodiments formed from a polymer material such as a thermoplastic polyurethane (TPU). The belt 16 has a belt width 30 and a belt thickness 32, with an aspect ratio of belt width 30 to belt thickness 32 greater than one. The belt 16 defines a traction side 34, which is interactive with the traction sheave 24 and a back side 36 opposite the traction side 34. The belt 16 further defines belt edges 38 extending between the traction side 34 and the back side 36.

Figure 3:
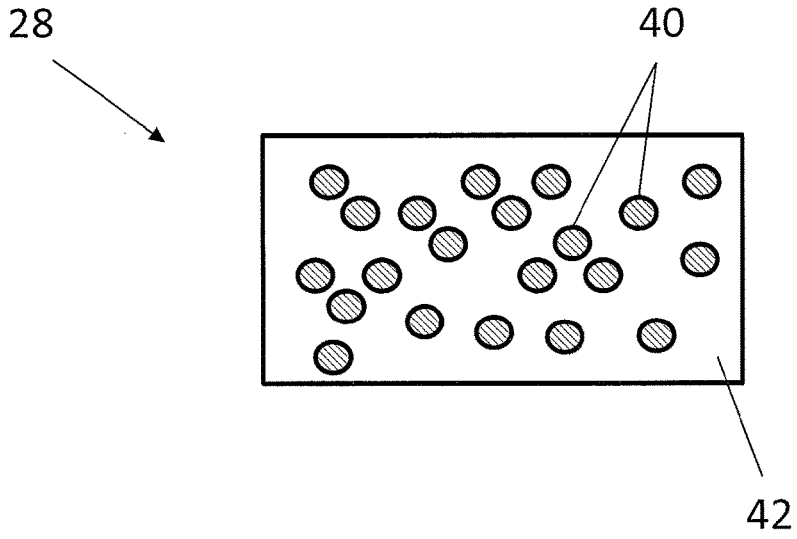
FIG. 3 illustrates an embodiment of a tension element for a belt of an elevator system.

Referring now to FIG. 3, the tension elements 28 include a plurality of fibers 40 bonded to a polymer matrix 42 to form the tension elements 28. The fibers 40 are continuous or discontinuous or combination of continuous and discontinuous over the belt 16 length and, oriented generally such that a fiber 40 length is directed along the belt 16 length. The fibers 40 may be formed of one or more of a number of materials, such as carbon, glass, polyester, nylon, aramid or other polymer materials. Further, the fibers 40 may be organized into a grouping, such as a spun yarn. The matrix 42 may be formed of, for example a thermoset or thermoplastic material. The tension element 28 is further configured to have a fiber 40 density of 30% to 70% fibers 40 per unit of volume. In some embodiments, the fibers 40 may vary in size, length or circumference and may further be intentionally varied to provide a selected maximum fiber 40 density. While in the embodiment of FIG. 3, the tension elements 28 are formed from a plurality of fibers 40, one skilled in the art will readily appreciate that the features of the present disclosure may be utilized with belts 16 having tension elements 28 formed in other ways, for example, tension elements 28 formed from a plurality of steel wires.

Figure 4:
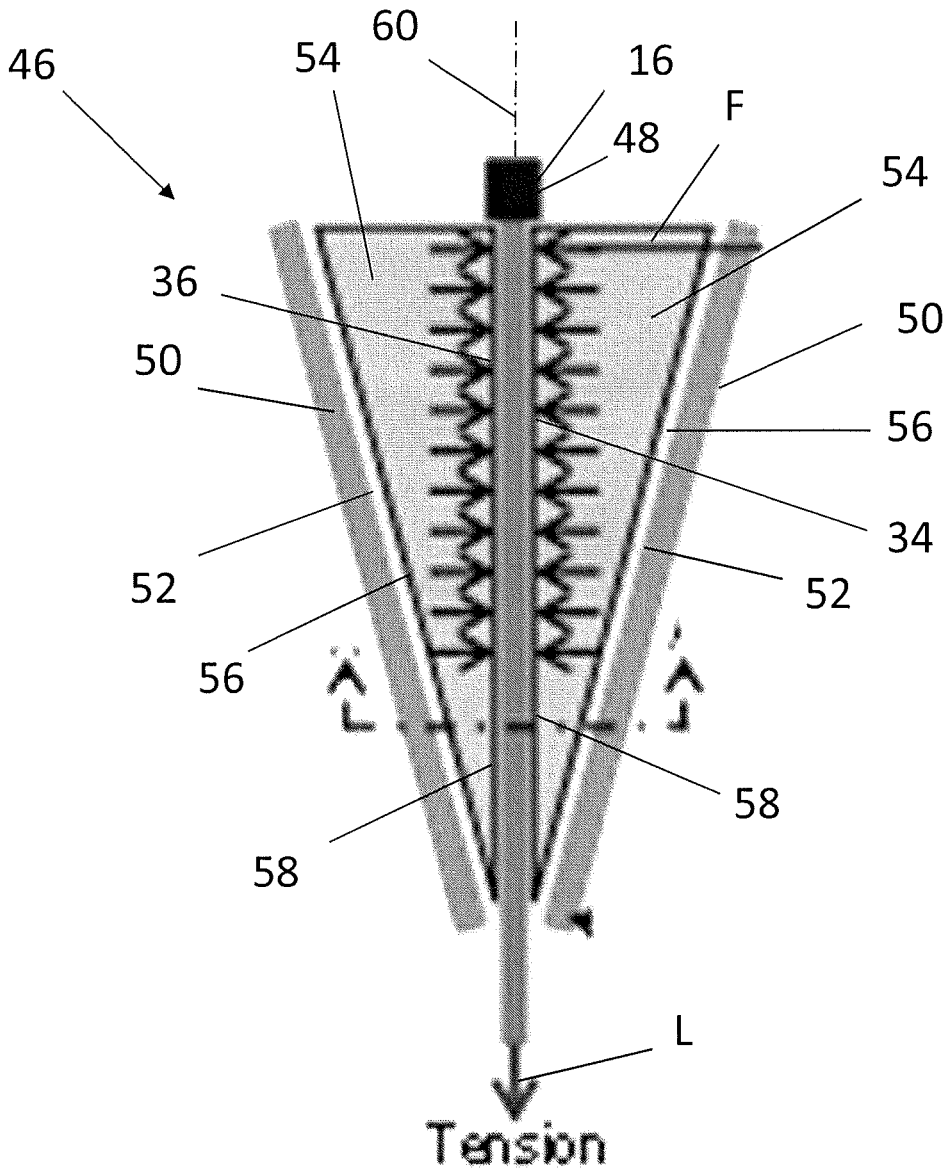
FIG. 4 illustrates a side cross-sectional view of a symmetric wedge termination for a belt of an elevator system.

Referring now to FIG. 4, an embodiment of a termination 46 is illustrated. A belt end 48 of the belt 16 is installed and retained in the termination 46 at, for example, the elevator car 12 or the counterweight 22, as shown in FIG. 1. The termination 46 includes a housing 50, with a housing inner surface 52 having a housing taper, in which the housing inner surface 52 tapers inwardly toward the belt 16 with increasing distance from the belt end 48. Two wedges 54 are installed in the housing 50 between the housing inner surface 52 and the belt 16. A first wedge 54 is installed between the housing inner surface 52 and the traction surface 34 of the belt 16, with the wedge 54 interactive with the traction surface 34. Additionally, a second wedge 54 is installed between the housing inner surface 52 and the back surface 36 of the belt 16 and is interactive with the back surface 36. Each wedge assembly 54 includes a wedge outer surface 56 abutting the housing inner surface 52 and having a wedge taper and a wedge inner surface 58 abutting the belt 16. While the embodiment of FIG. 4 the termination 46 includes two wedges 54, in other embodiments, such as in FIG. 5, the termination 46 includes a single wedge 54.

When a load L is applied along a belt axis 60, the wedge 54 travels along the belt axis 60 because the friction force between the wedge 54 and the housing inner surface 52 is less than the friction force between the wedge 54 and the belt 16, and because of the taper of the housing inner surface 52 and the complimentary wedge outer surface 56, moves inwardly toward the belt 16, thus applying a clamping force F to the belt 16 to retain the belt 16 at the termination 46. As the load L increases, the clamping force F similarly increases.

Figure 5:
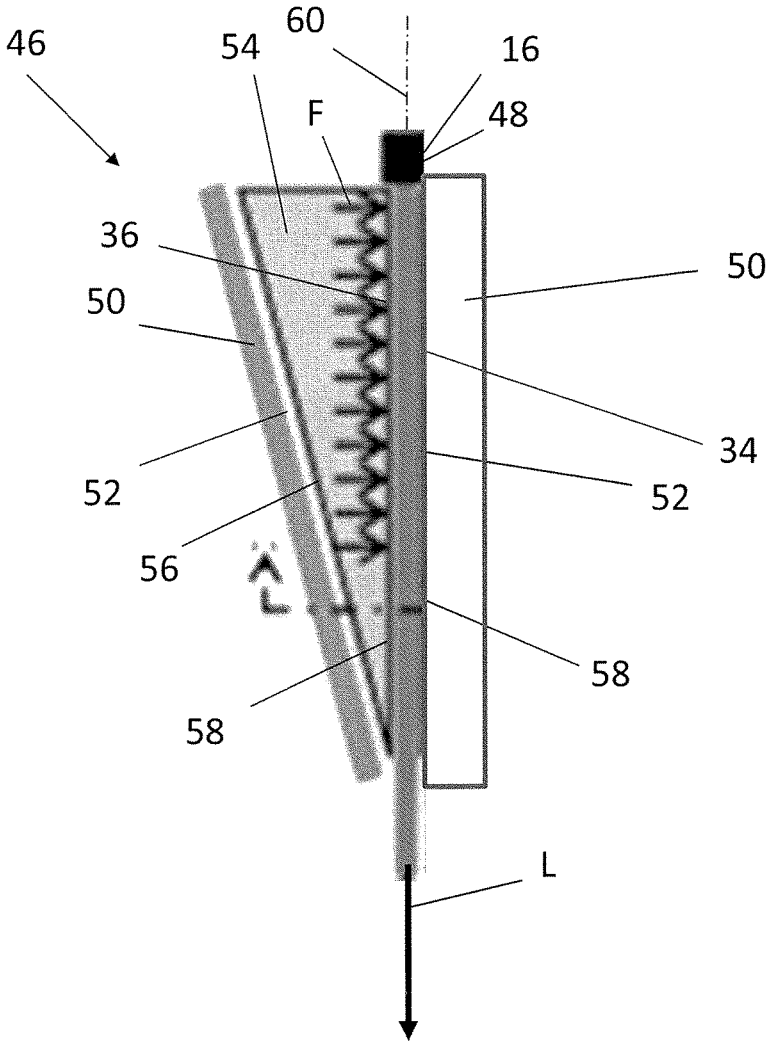
FIG. 5 illustrates a side cross-sectional view of a single wedge termination.
Figure 6:
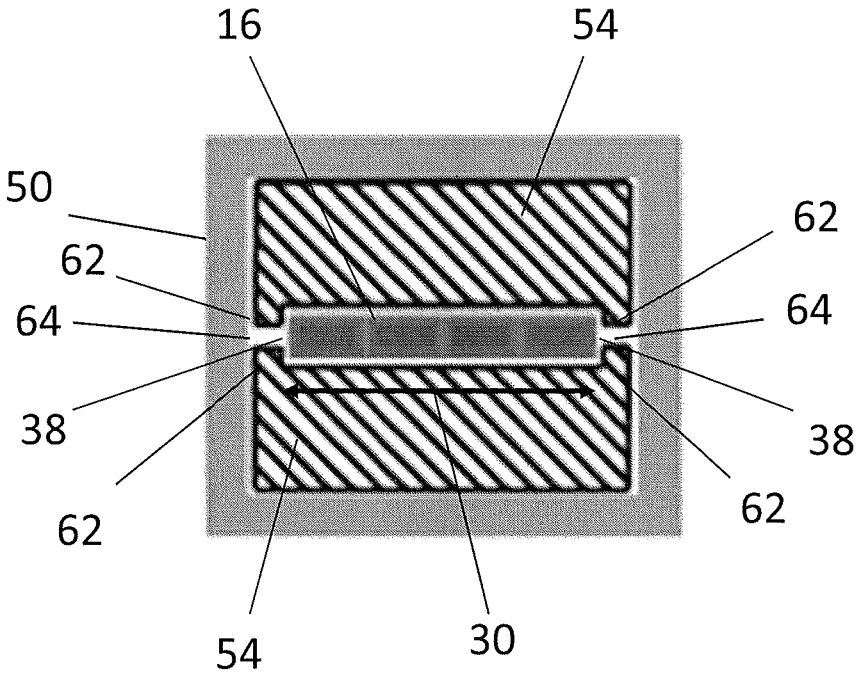
FIG. 6 illustrates a top cross-sectional view of a symmetric wedge termination before loading of the termination.
Figure 7:
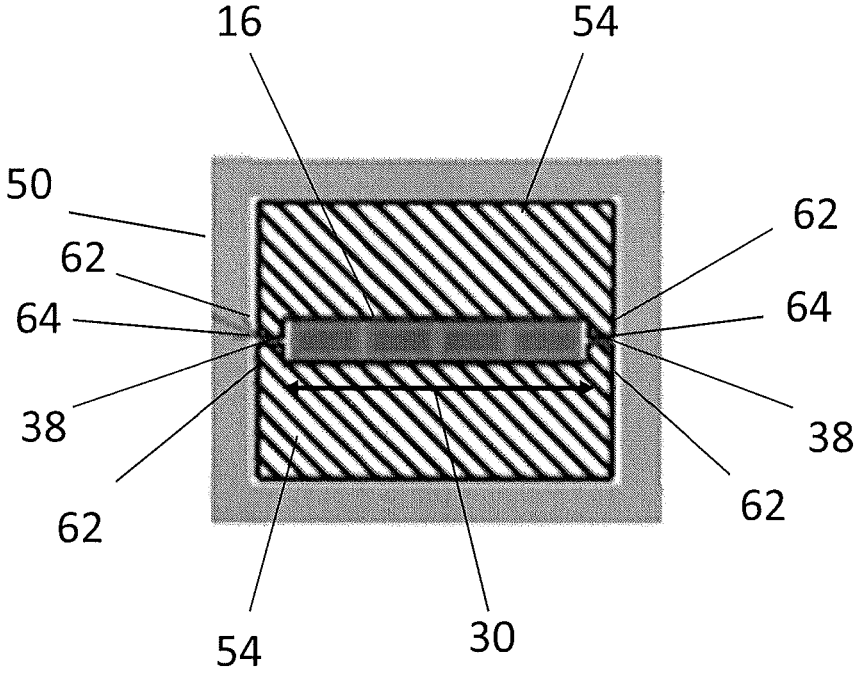
FIG. 7 illustrates a top cross-sectional view of a symmetric wedge termination after loading of the termination.

Referring now to FIGS. 6 and 7, a top cross-sectional view of termination 46 is illustrated. FIG. 6 depicts the termination 46 before load L is applied to the belt 16, while FIG. 7 depicts the termination 46 when the load L is applied. Wedge 54 extends laterally beyond the belt width 30 and includes a wedge lip 62 that extends at least partially across the belt thickness 32 at the belt edge 38. When the load L is applied, the wedges 54 approach each other, and thus the wedge lips 62 of the opposing wedges 54 approach each other as shown in FIG. 7, to reduce a wedge gap 64 between the wedge lips 62. The reduction of the wedge gap 64 at the belt edges 38 supports the belt edges 38 to prevent creep or flow of the jacket 44 outwardly into or through the wedge gap 64. Prevention of the creep or flow of the jacket 44 preserves the clamping load at the termination 46, thus reducing risk of belt 16 slip through the termination 46. While in the embodiments illustrated in the drawings each wedge 54 includes a wedge lip 62, it is to be appreciated that in other embodiments, one of the wedges 54 may include a wedge lip 62, while the other wedge 54 does not include a wedge lip. Additionally, in a termination 46 having a single wedge 54 such as shown in FIG. 5, the housing 50 opposing the wedge 54 may have a housing lip (not shown) interactive with the wedge lip 62 with the wedge gap defined between the wedge lip 62 and the housing lip.

Figure 8:
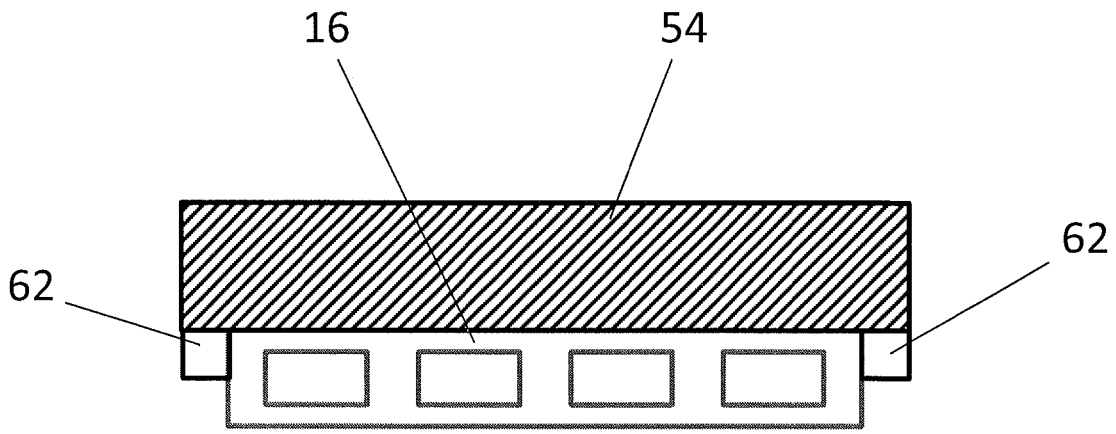
FIG. 8 illustrates a top cross-sectional view of another termination for a belt of an elevator system.

In some embodiments, the wedge lips 62 are formed from the same material as the wedges 54, for example, a steel or other metallic material. In other embodiments, such as illustrated in FIG. 8, the wedge lips 62 may be formed from a different, softer material than the wedges 54. The wedge lips 62 can be compressible, and formed from a rubber or elastomer material. This material difference enables the desired clamping load to be applied while reducing the wedge gap 64 to the desired degree to prevent jacket 44 creep. In some embodiments, the opposing wedge lips 62 are in contact when the load L is applied.

Figure 9:
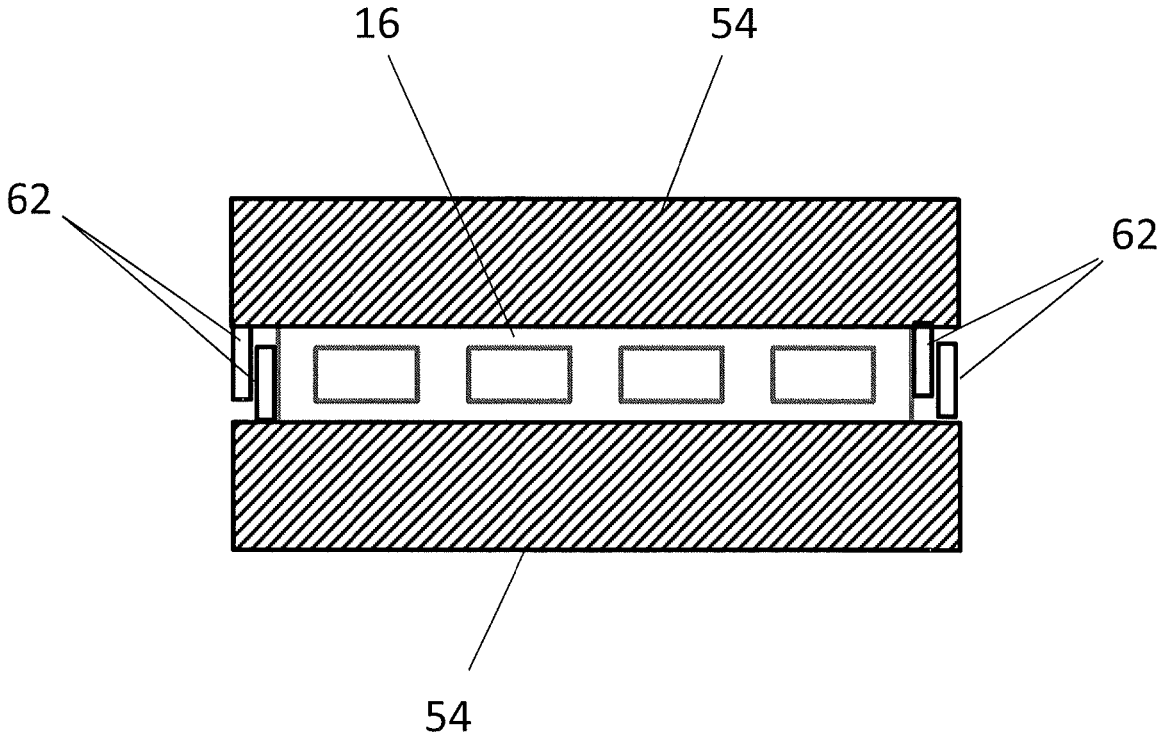
FIG. 9 illustrates a top cross-sectional view of yet another termination for a belt of an elevator system.
Figure 10:
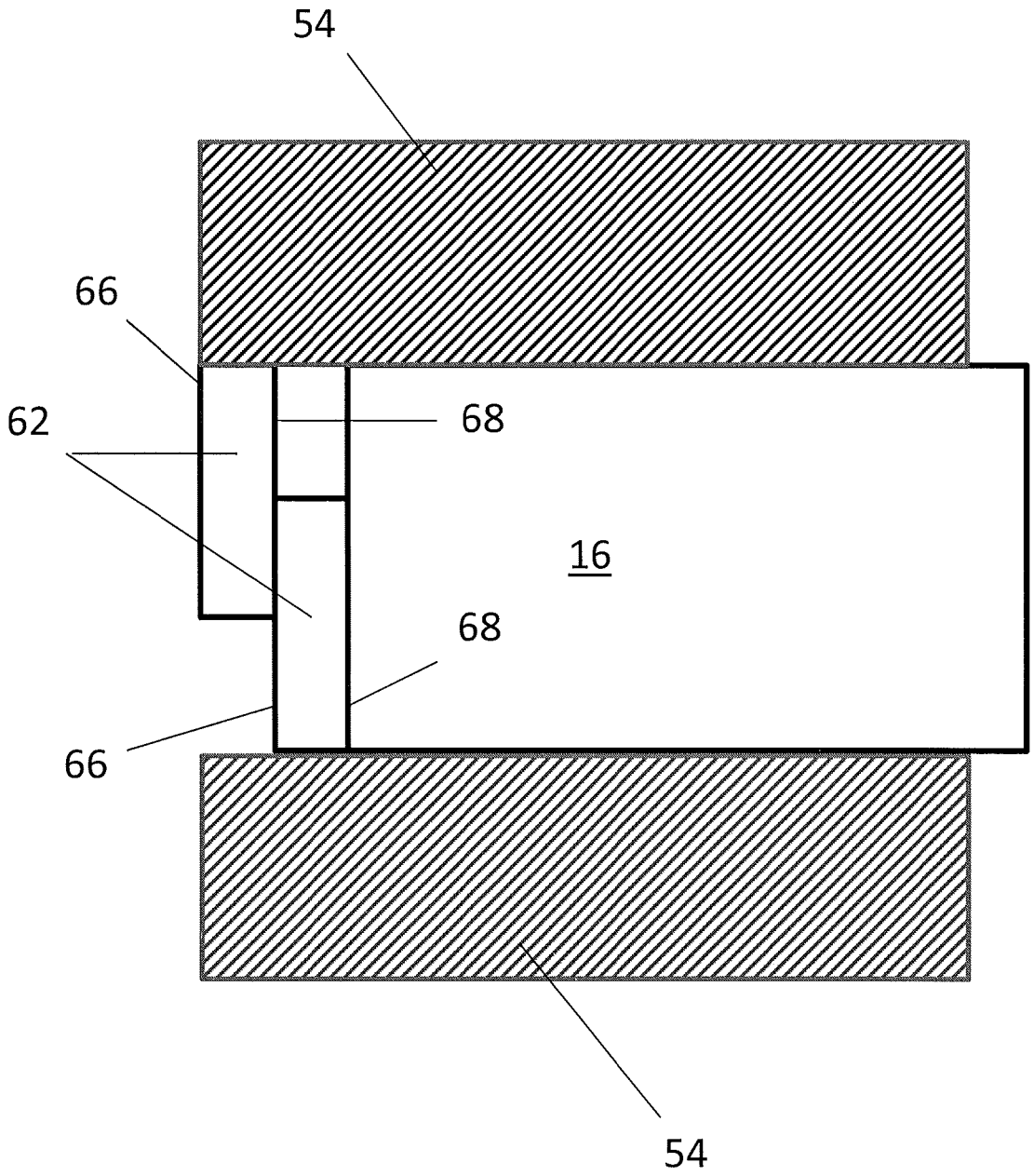
FIG. 10 illustrates a detail of the embodiment of FIG. 9.

Referring now to FIGS. 9 and 10, in other embodiments, the wedge lips 62 are configured to overlap along the belt thickness 32 at the belt edge 38 forming a lap joint. Each wedge lip 62 has a lip outer surface 66 and a lip inner surface 68. In this configuration, a first lip outer surface 66 is offset from a second lip outer surface 66, and similarly the lip inner surfaces are offset. The lip surfaces 66, 68 are offset such that a lip outer surface 66 overlaps a lip inner surface 68 to provide sealing and prevent the jacket 44 flow or creep. To prevent binding of the wedge lips 62 at the overlap the overlapping surfaces may be coated with, for example, a Teflon or other friction-reducing material to enable movement of the overlapping surfaces across each other.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A termination device for a suspension member of an elevator system comprising:

a housing; and two opposing wedges disposed in the housing and configured such that the suspension member is receivable therebetween, each wedge extending across a width of the suspension member and at least partially across a thickness of the suspension member, each wedge interactive with the suspension member to apply a clamping force to the suspension member in response to an axial load acting on the suspension member, each wedge including a wedge lip disposed at a lateral end of each wedge configured to contain the suspension member within a lateral extent of each wedge by at least partially overlapping a lateral end of the suspension member;

wherein a first wedge lip of a first wedge of the two opposing wedges is configured to overlap a second wedge lip of a second wedge of the two opposing wedges.

2. The termination device of claim 1, wherein each wedge is formed from a first material and at least one of the first wedge lip and the second wedge lip is formed from a second material softer than the first material.

3. The termination device of claim 1, wherein the wedge lip is compressible.

4. A termination assembly of a belt for an elevator system, comprising:

the belt including:

a plurality of tension members extending along a length of the belt; and a jacket at least partially enclosing the plurality of tension members;

a termination device including:

a housing; and two opposing wedges disposed in the housing such that the belt is disposed between the two opposing wedges, each wedge extending across a lateral width of the belt and at least partially across a thickness of the belt, each wedge interactive with the belt to apply a clamping force to the belt in response to an axial load acting on the belt, each wedge including a wedge lip disposed at a lateral end of each wedge configured to contain the belt within a lateral extent of each wedge by at least partially overlapping a lateral end of the belt;

wherein a first wedge lip of a first wedge of the two opposing wedges is configured to overlap a second wedge lip of a second wedge of the two opposing wedges.

5. The termination assembly of claim 4, wherein at least one of the first wedge lip and the second wedge lip is compressible.

6. The termination assembly of claim 4, wherein the plurality of tension members are formed from a plurality of fibers bonded to a polymer matrix.

7. The termination assembly of claim 4, wherein the jacket is formed from an elastomeric material.

8. An elevator system comprising:

a hoistway;

an elevator car disposed in the hoistway;

a belt operably connected to the elevator car to suspend and/or drive the elevator car along the hoistway; and a termination device disposed in the hoistway and operably connected to a belt end of the belt, the termination device including:

a housing; and two opposing wedges disposed in the housing such that the belt is disposed between the two opposing wedges, each wedge extending across a lateral width of the belt and at least partially across a thickness of the belt, each wedge interactive with the belt to apply a clamping force to the belt in response to an axial load acting on the belt, each wedge including a wedge lip disposed at a lateral end of each wedge configured to contain the belt within a lateral extent of each wedge by at least partially overlapping a lateral end of the belt;

wherein a first wedge lip of a first wedge of the two opposing wedges is configured to overlap a second wedge lip of a second wedge of the two opposing wedges.

9. The elevator system of claim 8, wherein the termination device is located at the elevator car or a counterweight of the elevator system.

10. The elevator system of claim 8, wherein at least one of the first wedge lip and the second wedge lip is compressible.

* * * * *